US007500881B1

(12) United States Patent
Lin

(10) Patent No.: US 7,500,881 B1
(45) Date of Patent: Mar. 10, 2009

(54) ADAPTER FOR AN AUTOMOBILE SOCKET

(75) Inventor: Christina Lin, Taipei (TW)

(73) Assignee: Sonnenschein Industry Co., Ltd., Taipei (TW)

( * ) Notice: Subject to any disclaimer, the term of this patent is extended or adjusted under 35 U.S.C. 154(b) by 0 days.

(21) Appl. No.: 12/000,802

(22) Filed: Dec. 18, 2007

(51) Int. Cl.
*H01R 24/04* (2006.01)

(52) U.S. Cl. ..... 439/668

(58) Field of Classification Search ..... 439/668, 439/669

See application file for complete search history.

(56) References Cited

U.S. PATENT DOCUMENTS

| | | | | |
|---|---|---|---|---|
| 2,149,549 | A * | 3/1939 | Reis | 439/6 |
| 4,109,988 | A * | 8/1978 | Olson | 439/265 |
| 4,248,494 | A * | 2/1981 | McDonald et al. | 439/638 |
| 5,708,706 | A * | 1/1998 | Hughes et al. | 379/446 |
| 5,964,623 | A * | 10/1999 | Maher et al. | 439/668 |
| 6,368,157 | B1 * | 4/2002 | Bottazzi, Jr. | 439/668 |
| D463,369 | S * | 9/2002 | Eisenbraun | D13/144 |
| 6,478,628 | B1 * | 11/2002 | Ming | 439/668 |
| 6,551,142 | B2 * | 4/2003 | Eisenbraun | 439/668 |
| 6,612,875 | B1 * | 9/2003 | Liao | 439/675 |
| 6,641,405 | B2 * | 11/2003 | Chou | 439/32 |
| 6,767,256 | B1 * | 7/2004 | Faerber et al. | 439/668 |
| 6,855,003 | B1 * | 2/2005 | Wyant | 439/502 |
| 6,902,437 | B1 * | 6/2005 | Wang | 439/668 |
| 6,923,686 | B1 * | 8/2005 | Cheng | 439/668 |
| 7,040,923 | B1 * | 5/2006 | Min-Chen et al. | 439/534 |
| 7,338,328 | B2 * | 3/2008 | Krieger et al. | 439/668 |
| 2002/0119708 | A1 * | 8/2002 | Eisenbraun | 439/668 |

* cited by examiner

*Primary Examiner*—T C Patel
*Assistant Examiner*—Vladimir Imas
(74) *Attorney, Agent, or Firm*—Rosenberg, Klein & Lee

(57) ABSTRACT

An adapter for an automobile socket comprises a plug; a flexible coating element, two fixing elements, one adapter element, and two conducting wires. The adapter element has at least one insertion hole. The flexible coating element two interconnected through holes. The two fixing elements are disposed at the two ends of the flexible coating element. The plug and the adapter element are fixed respectively at the two fixing elements. The conducting wires penetrate the through holes and connect electrically the plug and the adapter element. Via this arrangement, the user can bend the flexible coating element and the conducting wires to bring the adapter element to a suitable position, making it convenient for the user to insert a cigarette lighter or other electrical apparatus.

6 Claims, 6 Drawing Sheets

ADAPTER FOR AN AUTOMOBILE SOCKET

BACKGROUND OF THE INVENTION

1. Field of the Invention

The present invention relates to an adapter for an automobile socket, and in particular to an adapter inserted into the cigarette lighter socket of an automobile.

2. Description of Related Art

Most automobiles contain a cigarette lighter and a corresponding socket. When the cigarette lighter is inserted into the socket and electrical contact is made, the resulting current will generate heat in the cigarette lighter.

Recently, along with the rapid development of car manufacturing, the socket in automobiles can also provide electrical power to a cell phone or a GPS system, so that the original socket with one single hole is not sufficient for some users.

The one-in-two type adapter for automobiles is already developed, having one plug and two insertion holes, whereby the plug is inserted into the socket of an automobile, and two insertion holes of the adapter cater for a cigarette lighter, charging a cell phone, or other apparatus.

However, the adapter for an automobile socket of the prior art can not be bent into different positions, and thus can be inconvenient to use in an automobile.

Therefore, in view of this, the inventor proposes the present invention to overcome the above described problem based on his expert experience and deliberate research.

SUMMARY OF THE INVENTION

The primary object of the present invention is to provide an adapter for an automobile socket which can be bent into different positions.

The adapter for an automobile socket comprises a plug; at least one insertion hole; a flexible coating element having two interconnected through holes; two fixing elements disposed respectively at the two ends of the flexible coating element, the plug and an adapter element fixed respectively at the two fixing elements; and two conducting wires penetrating the through holes and electrically connecting the plug and the adapter element.

The user can bend the flexible coating element and the conducting wires to bring the adapter element to a suitable position, making it convenient for the user to insert a cigarette lighter or other electrical apparatus.

In order to better understand the characteristics and technical contents of the present invention, a detailed description thereof will be made with reference to the accompanying drawings. However, it should be understood that the drawings and the description are illustrative and not intended to limit the scope of the present invention.

DETAILED DESCRIPTION OF THE PREFERRED EMBODIMENTS

Figure 1:
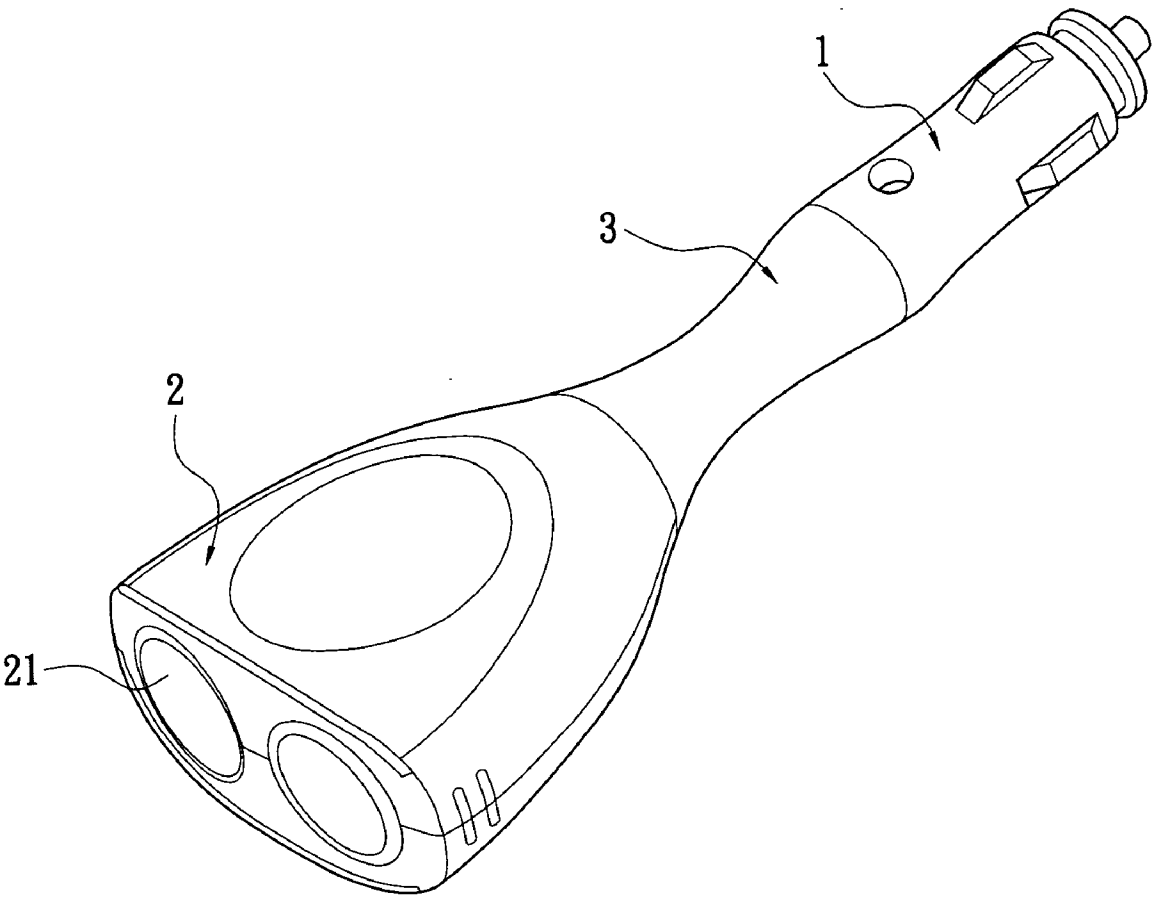
FIG. 1 is a perspective view of the adapter for an automobile socket according to the present invention.

Referencing FIG. 1 to FIG. 5, the present invention provides an adapter for an automobile socket, which comprises a plug 1, an adapter element 2, a flexible coating element 3, two fixing elements 4, and two conducting wires 51 and 52.

Figure 2:
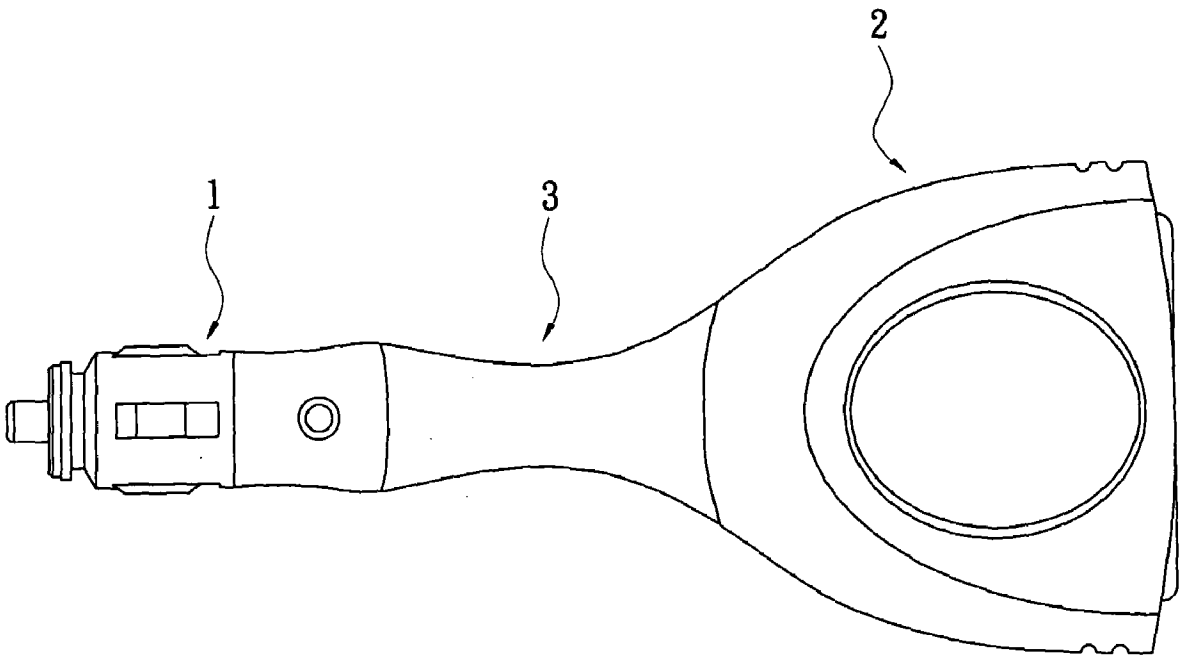
FIG. 2 is a bottom view of the adapter for an automobile socket according to the present invention.
Figure 5:
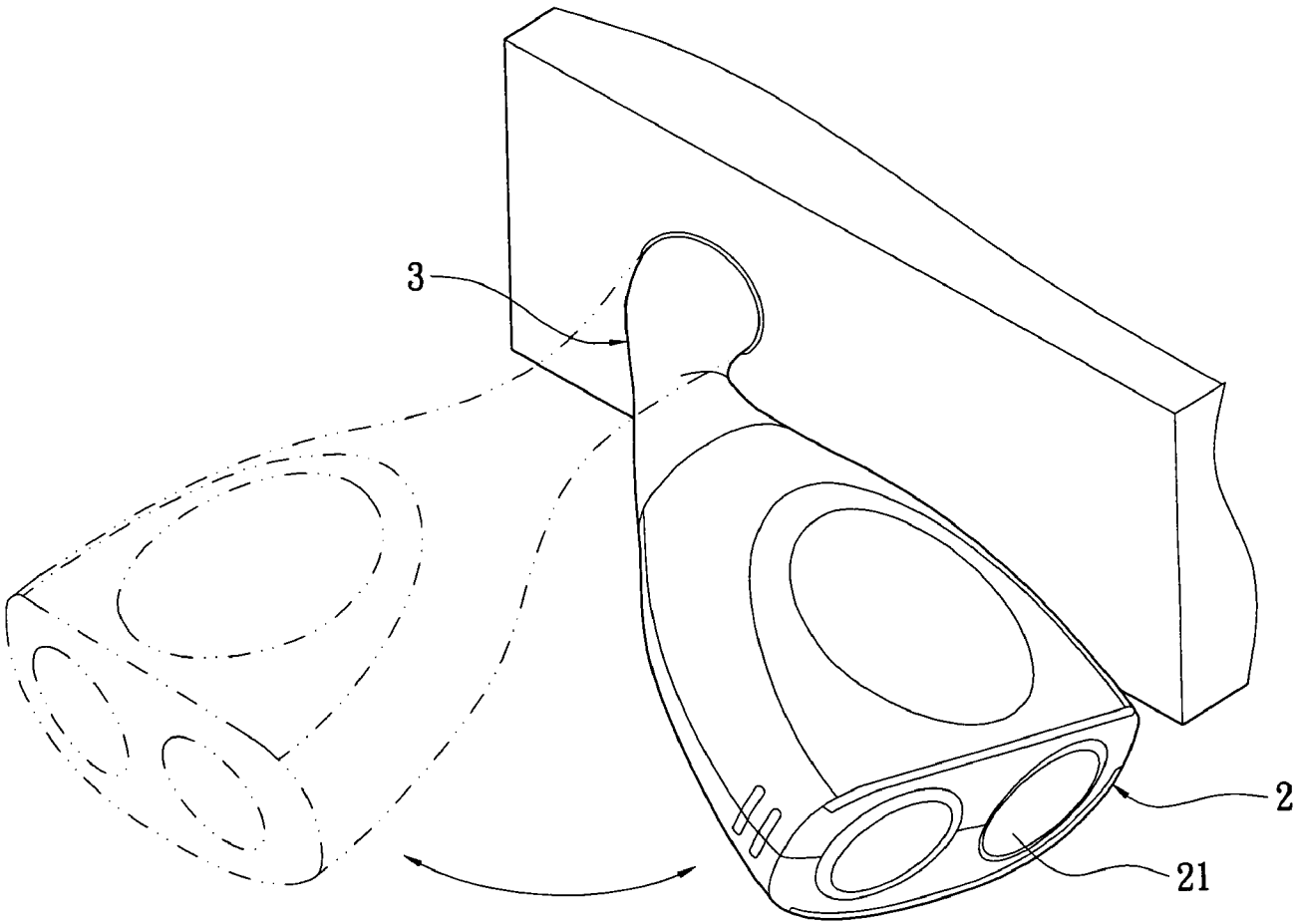
FIG. 5 is a perspective view of the adapter bending and positioning according to the present invention.

With reference to FIG. 1, FIG. 2, and FIG. 5, the plug 1 can be inserted into the socket of the automobile and transmit electric current to a cigarette lighter or other electric device.

The adapter element 2 is connected electrically with plug 1; the adapter element 2 has two insertion holes 21, and the two insertion holes 21 can provide electrical current from the automobile to a cigarette lighter and other electrical apparatus.

Figure 3:
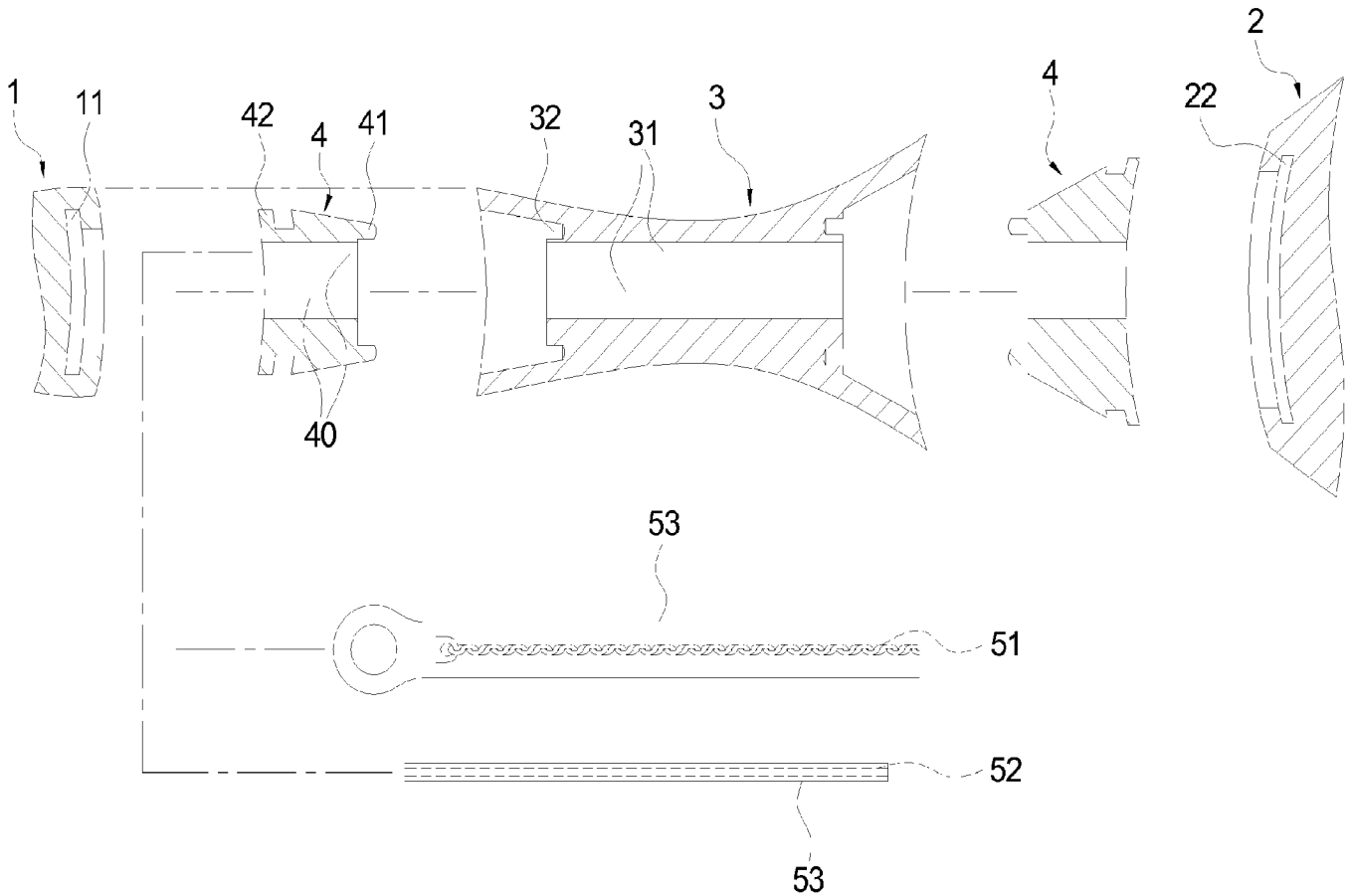
FIG. 3 is a exploded view of the adapter for an automobile socket according to the present in invention.

Referencing FIG. 3, two through holes 31 penetrate the flexible coating element 3 in the axial direction. The two through holes 31 are interconnected as shown in FIG. 4 and FIG. 4*a* in order to enhance the flexibility of flexible coating element 3.

Figure 4:
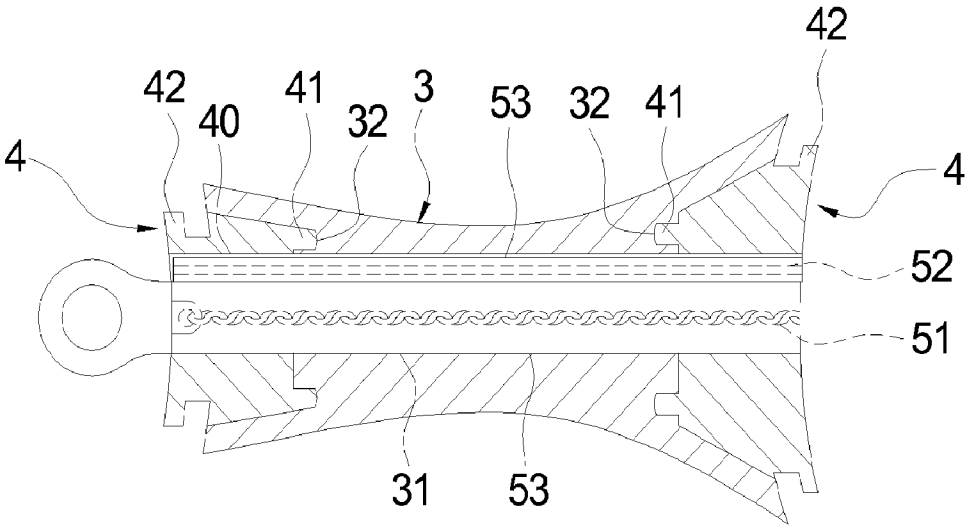
FIG. 4 is an assembled view of the middle section of the adapter for an automobile socket according to the present invention.
Figure 4A:
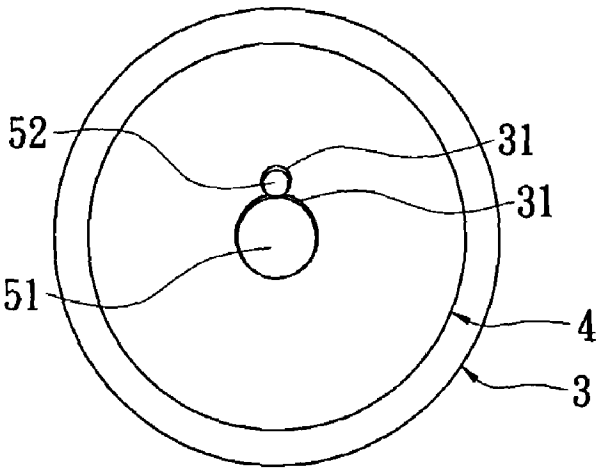
FIG. 4*a* is a side view of the FIG. 4 according to the present invention.

Referencing FIG. 3 to FIG. 4, the two fixing elements 4 are disposed at two ends of the flexible coating element 3, respectively, and have through holes 40 corresponding to the through holes 31. The two fixing elements 4 are connected respectively with plug 1 and adapter element 2 and with the two ends of flexible coating element 4.

The two fixing elements 4 each have a butting portion 41 and a connecting portion 42, each of the two ends of the flexible coating element 3 have a connecting groove 32 corresponding to the butting portion 41, and the butting portions 41 of the fixing elements 4 are fixed in the connecting grooves 32 of the flexible coating element 3.

The plug 1 has a first fastening portion 11, and the adapter element 2 has a second fastening portion 22, the first fastening portion 11 and the second portion 22 both are circular grooves. The connecting portion 42 of one of the two fixing elements 4 is fastened on the first fastening portion 11 of plug 1, and the connecting portion 42 of the other fixing element 4 is fastened on the second fastening portion 22 of the adapter element 2. Thus, plug 1 and adapter element 2 are fixed on the two ends of the flexible coating element 3 via the two fixing elements 4.

The conducting wires 51 and 52 can transfer electric current from the automobile. The conducting wires 51 and 52 include a twisting wire 51 and a copper wire 52, the twisting wire 51 and the copper wire 52 both being coated by an insulating layer 53 to prevent a short circuit.

The twisting wire 51 and the copper wire 52 both penetrate through holes 31 of the flexible coating element 3 and through holes 40 of the fixing element 4. The two ends of twisting wire 51 and copper wire 52 are respectively electrically connected with plug 1 and adapter element 2.

Referencing FIG. 5, when plug 1 is inserted into the socket of the automobile, the user can bend the flexible coating portion 3 and conducting wires 51 and 52 to bring adapter element 2 into a suitable position for the user.

This makes it convenient for the user to insert a cigarette lighter or other electrical apparatus.

Although the present invention has been described with reference to the foregoing preferred embodiments, it will be understood that the invention is not limited to the details thereof. Various equivalent variations and modifications may still occur to those skilled in this art in view of the teachings of the present invention. Thus, all such variations and equivalent modifications are also embraced within the scope of the invention as defined in the appended claims.

What is claimed is:

1. An adapter for an automobile socket, comprising;

a plug;

an adapter element having at least one insertion hole;

a flexible coating element having two through holes, the flexible coating element having a respective connecting groove at each of two ends thereof;

two fixing elements disposed respectively at the two ends of the flexible coating element, each of the two fixing elements having a butting portion, the butting portion of the fixing elements being fixed in the connecting grooves of the flexible coating element, the plug and the adapter element being respectively fixed at the two fixing elements; and two conducting wires penetrating the through holes and connecting electrically the plug and the adapter element.

2. The adapter for an automobile socket according to claim 1, wherein the two through holes are interconnected within the flexible coating element.

3. The adapter for an automobile socket according to claim 1, wherein the conducting wires include a twisting wire and a copper wire.

4. The adapter for an automobile socket according to claim 3, wherein the twisting wire and the copper wire are coated with an insulating layer.

5. The adapter for an automobile socket according to claim 1, wherein the plug has a first fastening portion, the adapter element has a second fastening portion, the fixing elements have a connecting portion, the connecting portion of the two fixing elements being fastened to the first fastening portion of the plug and the second fasten portion of the adapter element, respectively.

6. The adapter for an automobile socket according to claim 1, wherein the adapter element has two insertion holes.

* * * * *